US006978889B2

(12) United States Patent
McBride

(10) Patent No.: US 6,978,889 B2
(45) Date of Patent: Dec. 27, 2005

(54) WIPER SHEET PACKAGING SYSTEM

(75) Inventor: John McBride, Spartanburg, SC (US)

(73) Assignee: Contec Inc., Spartanburg, SC (US)

( * ) Notice: Subject to any disclaimer, the term of this patent is extended or adjusted under 35 U.S.C. 154(b) by 116 days.

(21) Appl. No.: 10/771,771

(22) Filed: Feb. 4, 2004

(65) Prior Publication Data

US 2005/0167293 A1 Aug. 4, 2005

(51) Int. Cl.[7] ..... B65D 73/00
(52) U.S. Cl. ..... 206/210; 206/233; 206/494; 206/812
(58) Field of Search ..... 206/205, 210, 206/425, 449, 494, 581, 812, 823, 233

(56) References Cited

U.S. PATENT DOCUMENTS 5,361,905 A * 11/1994 McQueeny et al. ..... 206/494
5,688,394 A * 11/1997 McBride et al. ..... 206/494
5,802,655 A * 9/1998 Denton ..... 206/494
6,026,953 A * 2/2000 Nakamura et al. ..... 206/494
6,164,441 A * 12/2000 Guy et al. ..... 206/210
6,371,296 B1 * 4/2002 Rumbough ..... 206/494
2003/0217946 A1 * 11/2003 Hsu ..... 206/494

* cited by examiner

*Primary Examiner*—Luan K. Bui
(74) *Attorney, Agent, or Firm*—J.M. Robertson Intellectual Prop. LLC

(57) ABSTRACT

A wiper sheet packaging arrangement including an envelope package incorporating a mouth opening with at least one pair of adjacent columns of stacked folded wiper sheets with folded edges of the wiper sheets aligned in transverse relation to the mouth opening. The folded edges of the wiper sheets in adjacent columns are disposed in opposing relation to define a finger access channel between the adjacent columns.

8 Claims, 1 Drawing Sheet

WIPER SHEET PACKAGING SYSTEM

FIELD OF INVENTION

The present invention is directed generally to a packaging arrangement for substantially planar cleaning wipes and more specifically to a cleaning wipe package incorporating a pliable containment envelope with an arrangement of folded cleaning wipes disposed in folded stacked arrangement within the contaminate envelope such that the wipes form a pair of columns with folded edges in opposing relation.

BACKGROUND OF THE INVENTION

Cleaning wipes of textile constructions are known. Such wipes may be presaturated with a solvent or other cleaning agent within an appropriate package. Such packages may be in the form of a flexible envelope container which may be opened to gain access to the enclosed wipes. Such a container may be resealable to prevent evaporation of saturating cleaning agents.

In the past, substantially flat wiper sheets have been packaged within envelope containers using a simple stacked arrangement with the individual sheets being disposed in flat, overlying relation relative to one another. Such packaging arrangements provide excellent space utilization within the envelope containers. However, such packaging arrangements may give rise to difficulty in removing a single wiper sheet without simultaneously pulling additional wipes. That is, the surface tension and overlapping area of the stacked wipers is such that two or more wipes may stick together.

SUMMARY OF THE INVENTION

The present invention provides advantages and alternatives over past wiper sheet packaging arrangements by providing an envelope package incorporating a mouth opening with at least one pair of adjacent columns of stacked folded wiper sheets with folded edges of the wiper sheets aligned in transverse intersecting relation to the mouth opening. The folded edges of the wiper sheets in adjacent columns are disposed in opposing relation to define a finger access channel between the adjacent columns. An individual wiper sheet may be withdrawn by grasping the folded edge of the wiper sheet and withdrawing the wiper sheet through the mouth opening.

While the invention has been illustrated and will hereafter be described in connection with certain exemplary and potentially preferred embodiments, practices and procedures, it is to be understood that the invention is in no way limited to any such illustrated and described embodiments practices and procedures. Rather, it is to be understood that it is the intention of the applicant to cover all alternatives and modifications as may fall broadly within the spirit and scope of the invention.

DESCRIPTION OF PREFERRED EMBODIMENTS

Figure 1:
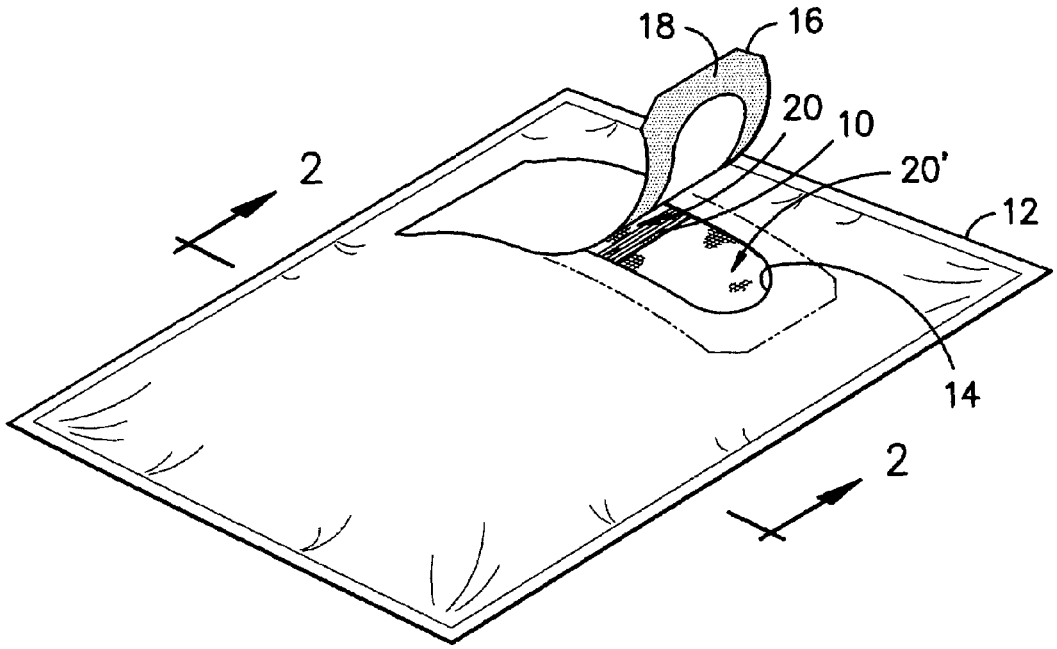
FIG. 1 is an elevation perspective view of an envelope packaging container including a packaging arrangement of folded wiper sheets within a pair of adjacent columns formed by a multiplicity of stacked wiper sheets with folded edges disposed at inboard positions extending transverse to a mouth opening and wherein a portion of the sheets from one column have been removed.
Figure 2:
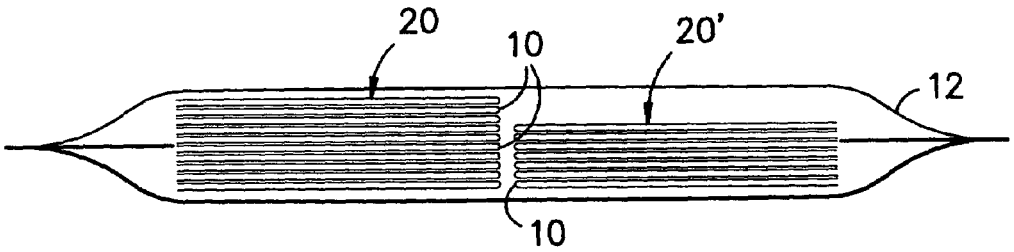
FIG. 2 is a view taken generally along line 2—2 in FIG. 1 illustrating the stacked arrangement of folded wiper sheets defining a pair of columns with opposing folded edges.

Reference will now be made to the drawings wherein to the extent possible like reference numbers are utilized to designate like elements throughout the various views. Looking simultaneously to FIGS. 1 and 2 there is illustrated a packaging arrangement for a multiplicity of wiper sheets 10 which may be of either a single ply or multi-ply construction. By way of example only, it is contemplated that the wiper sheets 10 may be formed from a woven, knit or non-woven absorbent textile material which has been presaturated with a solvent or other cleaning agent. The wiper sheets 10 have sufficient pliability to permit folding as illustrated.

As shown, the wiper sheets 10 are stored within a containment envelope 12 including an elongate mouth opening 14 with a cover 16 adapted to be held in substantially sealing relation over the mouth opening 14 prior to use. As shown, the cover 16 preferably includes an adhesive zone 18 which attaches to the surface of the envelope 12 at least partially around the perimeter of the mouth opening 14 so as to provide the desired sealing relationship. According to one contemplated practice, the adhesive zone 18 incorporates a pressure sensitive contact adhesive which retains at least a degree of adhesive strength following initial removal away from the mouth opening 14 so as to permit the envelope to be resealed by application of pressure if desired. Of course, other adhesive and non-adhesive systems such as non-renewable adhesives tear strips and the like may also be utilized if desired. Likewise, other mouth geometries may also be used if desired.

The envelope 12 is preferably formed from a flexible, air tight plastic or film material so as to accommodate packaging of the wiper sheets without evaporation of any pre-applied agents. The flexible nature of the envelope 12 also aids in causing the mouth opening 14 to at least partially close upon removal of the underlying wiper sheets. That is, as bulging is reduced the upper and lower edges of the mouth opening tend to collapse towards one another thereby at least partially blocking evaporation of pre-applied agents on remaining wipes.

According to the illustrated packaging arrangement, the wiper sheets 10 are folded substantially in half and arranged in stacked relation to form a pair of adjacent columns 20, 20' wherein each column has a number of stacked folded sheets with folded edges disposed in opposing relation to one another. By way of example only, in the event that the wiper sheets are square, following folding the sheets will have a width dimension which is approximately 50% of the width of the unfolded sheet while the length will remain substantially unchanged. Of course, it is also contemplated that other folding arrangements and a greater number of columns may be utilized if desired. For example, the individual wiper sheets may be folded in from two sides so as to give rise to two folded lateral edges. As will be appreciated, such a folding arrangement may facilitate the use of three or more columns since all lateral edges are folded.

As best illustrated, according to the contemplated practice the columns of stacked folded wiper sheets 10 are arranged such that the folded edges run generally transverse to the elongate mouth opening. Such an arrangement facilitates the insertion of a user's fingers between the opposing folded edges. Moreover, the folded edges are readily grasped as discrete units thereby reducing the possibility of pulling out more sheets than desired. Such a system thereby avoids unnecessary waste.

What is claimed is:

1. A wiper sheet packaging system consisting essentially of a containment envelope of pliable material including a mouth opening, a first plurality of stacked, folded wiper sheets defining a first column of wiper sheets, wherein folded edges of said first plurality of stacked, folded wiper sheets defines a folded lateral boundary of said first column and at least a second plurality of stacked, folded wiper sheets defining a second column of wiper sheets, wherein folded edges of said second plurality of stacked, folded wiper sheets defines a folded lateral boundary of said second column, and wherein the folded lateral boundary of the first column is disposed in opposing relation to the folded lateral boundary of the second column without a barrier between the first column and the second column such that during use the folded lateral boundary of said first column is unobstructed from contacting the folded lateral boundary of the second column and wherein the folded lateral boundary of the first column and the folded lateral boundary of the second column are disposed substantially transverse to said mouth opening.

2. The invention as recited in claim 1, further comprising a displaceable cover element disposed in sealing relation across the mouth opening, and wherein the cover element is adapted to be resealable across the mouth opening following removal.

3. The invention as recited in claim 1, wherein at least a portion of said first plurality of stacked folded wiper sheets is presaturated with a cleaning agent.

4. The invention as recited in claim 3, wherein at least a portion of said second plurality of stacked folded wiper sheets is presaturated with a cleaning agent.

5. The invention as recited in claim 1, wherein at least a portion of said first plurality of stacked folded wiper sheets comprises single ply textile sheets.

6. The invention as recited in claim 5, wherein said single ply textile sheets are presaturated with a cleaning agent.

7. The invention as recited in claim 5, wherein at least a portion of said second plurality of stacked folded wiper sheets comprises single ply textile sheets.

8. The invention as recited in claim 7, wherein said single ply textile sheets are formed of knitted textile material.

* * * * *